US009652910B2

(12) United States Patent
Tholen et al.

(10) Patent No.: US 9,652,910 B2
(45) Date of Patent: May 16, 2017

(54) ACCESS SYSTEM EMPLOYING DYNAMIC BADGES

(71) Applicant: FMR LLC, Boston, MA (US)

(72) Inventors: Laura W. Tholen, Raleigh, NC (US); John McDonough, Nahant, MA (US)

(73) Assignee: FMR LLC, Boston, MA (US)

( * ) Notice: Subject to any disclaimer, the term of this patent is extended or adjusted under 35 U.S.C. 154(b) by 0 days.

(21) Appl. No.: 14/751,408

(22) Filed: Jun. 26, 2015

(65) Prior Publication Data

US 2016/0379426 A1 Dec. 29, 2016

(51) Int. Cl.
*G07C 9/00* (2006.01)

(52) U.S. Cl.
CPC ..... *G07C 9/00015* (2013.01); *G07C 9/00103* (2013.01); *G07C 2009/0088* (2013.01)

(58) Field of Classification Search
None
See application file for complete search history.

(56) References Cited

U.S. PATENT DOCUMENTS 6,757,719 B1 * 6/2004 Lightman ..... G06Q 20/383 455/419
7,176,849 B1 * 2/2007 Mooney ..... G07C 9/00119 345/2.3
7,636,029 B1 * 12/2009 Zhou ..... G07C 9/00023 340/5.2
7,733,231 B2 * 6/2010 Carney ..... B42D 25/00 235/382
8,069,157 B2 * 11/2011 Jam ..... G06F 21/32 707/705
2002/0178138 A1 * 11/2002 Ender ..... G06F 17/30575
2003/0023874 A1 * 1/2003 Prokupets ..... G06F 21/32 726/4
2007/0198850 A1 * 8/2007 Martin ..... G07C 9/00087 713/186
2008/0048021 A1 * 2/2008 Shieh ..... G06Q 10/02 235/380
2009/0184842 A1 * 7/2009 Baldus ..... G06F 19/323 340/870.07
2009/0217076 A1 * 8/2009 Okuhara ..... G07C 1/10 713/600
2011/0314029 A1 * 12/2011 Fischer ..... G06F 17/30516 707/748
2012/0224057 A1 * 9/2012 Gill ..... G06F 21/55 348/143
2013/0325704 A1 * 12/2013 Gorman ..... G06Q 50/265 705/39

(Continued)

*Primary Examiner* — Quan-Zhen Wang
*Assistant Examiner* — Chico A Foxx
(74) *Attorney, Agent, or Firm* — Proskauer Rose LLP

(57) ABSTRACT

Techniques pertaining to management of and construction of a dynamic badge having at least one display device on the badge are described. A computer receives a message that identifies a user to which the badge is assigned, receive geographic location information that indicates a current location of the badge, access a database that stores information associated with the user; determining by the computer based on the accessed information and the current location of the badge the specific information to display on the display device; and forwards the determined information over a network to a communication node for delivery to the badge.

19 Claims, 9 Drawing Sheets

(56) References Cited

U.S. PATENT DOCUMENTS

| | | | | |
|---|---|---|---|---|
| 2014/0187152 | A1* | 7/2014 | Johnson | H04B 5/0031<br>455/41.1 |
| 2014/0189794 | A1* | 7/2014 | Ferdinand | H04L 63/08<br>726/3 |

* cited by examiner

ACCESS SYSTEM EMPLOYING DYNAMIC BADGES

BACKGROUND

This invention relates to access control in buildings and other premises.

Access control badges are commonly issued by companies, building management and other organizations to control access to their facilities to authorized individuals. Typically, identification (ID) badges are worn or carried by users to access buildings as well as internal areas within a building. Such badges commonly include one or more mechanisms that are read by card readers or the like to allow access to the user carrying the badge. Additionally, such badges often have the user's name and the user's picture printed on the badge. The badge may also have some printed identifier of the issuer of the badge, as well as other printed information.

SUMMARY

According to an aspect a method of managing a badge having at least one display device on the badge includes receiving by a computer a message that identifies a user to which the badge is assigned, receiving by the computer geographic location information that indicates a current location of the badge, accessing by the computer a database that stores information associated with the user, determining by the computer based on the accessed information and the current location of the badge the specific information to display on the display device, and forwarding by the computer the determined information over a network to a communication node for delivery to the badge.

Other aspects include systems and computer program products.

The following are some features of embodiments within the scope of the above aspect.

The method further includes establishing by a processor device on the badge, a communication channel with the computer that accesses a database that stores information associated with the user and the badge. The method further includes accessing by the computer a rule set that is based on the physical location of the badge at the time that the message is received. The method further includes establishing a communication channel with a computer that accesses a database that stores information associated with the user and the badge. The method further includes detecting by the computer establishment of a communication channel by circuitry on the badge and determining by the computer whether an update to the badge is required by executing one or more rules. Determining whether an update is required further includes accessing by the computer a record that associated with the badge, reading by the computer whether the record contains an acknowledgement message of a previous update being applied by the badge, and determining whether there is a new update for the badge that is later than a timestamp associated with the acknowledgement message. The method further includes sending by the computer the new update when the acknowledgement message has a timestamp later than a timestamp of the new update.

The method further includes producing by the computer an update package for the badge. Producing by the computer an update package, further includes receiving by the computer from NFC tags on the badge encoded information including the badge ID, determining by the computer the source address of an access point that read teh encoded information, determining by the computer, whether the access point is within a company's network, and applying by the computer a set of rules according to whether the access point is within or outside of the company network. The rules are a first set of on-company premises rules that includes a company events rule that when executed determines whether the badge ID is authorized to be at a specified event, by the server, accessing a list of attendees; and determining whether the badge ID is an authorized ID for the event; and sending an update to the badge, where the update is selected according to the execution of the company events rule. The rules are a first set of off-company premises rules that includes an employee termination rule that when executed determines whether the badge ID is a terminated badge, receiving from any access point that is connected with the badge from the NFC tag the encoded badge ID, accessing by the computer a list of terminated employees by badge ID, and update package ID when the identification of the badge is on the list. The update includes instructions that when executed by the badge, automatically wiped off all data from the display and disables a processor in the badge from receiving any further updates, by at least deleting a URL reference stored in the badge.

According to an additional aspect, a method of operating a badge having at least one electronic ink display device supported by the badge includes sending by a processor carried by the badge information securely held in the badge, which uniquely identifies a user to which the badge is assigned, receiving by the processor from a communication node a message having specific information for display by the display device, and causing the display device to display information according to the specific information in the received message.

The following are some features of embodiments within the scope of the above aspect.

Establishing by the processor device on the badge, a communication channel with a computer that accesses a database that stores information associated with the user and the badge.

One or more of the above aspects may provide one or more of the following advantages.

The disclosed techniques replace the current static ID badges with an enhanced ID badge that dynamically display names, graphics, event and dynamic specific information based on badge location. These "dynamic badges" interface with a server system. The dynamic badges can be used for access control and can also be utilized in hospitals by patients and personnel, in residential apartment or condominium settings, and in offices by office personnel and visitors. In addition, the dynamic functionality can be used to display employee names and departments for internal meetings, allowing personnel to easily identify each other for networking and communication purposes. In addition, the enhanced ID badge can be used in conjunction with the server system to significantly improve security measures to prevent data breaches, identity theft, and unauthorized access within an organizations premises.

Various dynamic badge use cases that involve specific server-side rule execution are provided. These use cases cause modifications to the dynamic badge providing additional capabilities to the badge, unlike conventional ID badges with fixed printed matter that employees, etc., commonly wear to access buildings, etc. The dynamic badges dynamically display names, and graphics, as well as event and dynamic-specific information. Thus, these dynamic badges can be used for much more than just access points, but also to display employee names and departments for internal meetings to reduce paper waste, can serve as name tags, etc. In addition, the dynamic badge could significantly improve controls for meetings were only certain people are authorized or invited to attend.

Badges are provided with electrophoretic displays and thus can have custom backgrounds that can display a variety messages, whether for internal meetings on company premises or meetings outside of company property. For a meeting, rather than printing many name tags for such meetings, the badges convert to a name tag and would display information appropriate for the meeting and could dynamically display event-specific images.

The dynamic badge can automatically be wiped clean if a person is terminated from employment or no longer permitted to access a building. The badge could be configured to automatically appear blank with no identifying information whatsoever once the employee is outside of a range of company property (in order to prevent improper use of the badge if lost or stolen, by using a lost badge to gain access by an unauthorized person). When back in range, the badge can be wirelessly reconfigured with appropriate information. Badges can be of different types for security level purposes and wearer status, e.g., contractor vs full time employee. Other advantages are disclosed herein.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
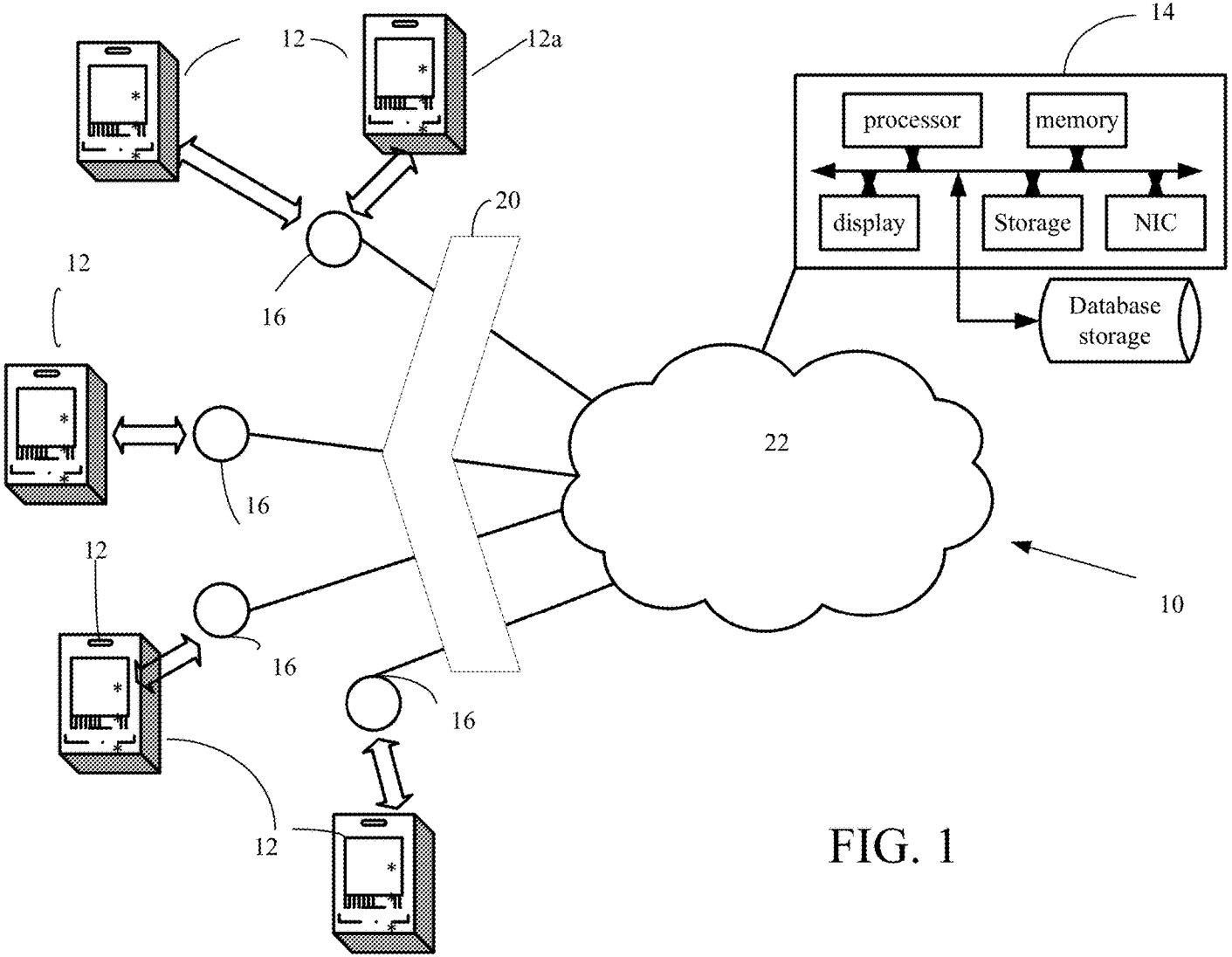
FIG. 1 is a system block diagram.

Referring now to FIG. 1, an access system 10 controlling dynamic badges 12 is shown. A plurality of dynamic badges generally 12 are configured to make connections over a network to a server computer system 14. One of the dynamic badges 12 is further referenced as dynamic badge 12*a* and will be referred to specifically in the discussion below. The plurality of dynamic badges 12 make such connections via open or dedicated wireless access points 16, e.g., hardware devices that are in physical locations, referred to here as hotspots, and which enable network, e.g., private network or the Internet access over a wireless local area network via a router connected to an server, e.g., an Internet service provider webserver.

In FIG. 1, the various wireless access points 16 and dynamic badges 12, as depicted, are intended to represent publically accessible, open non-log-in required hotspots at various, diverse physical locations. Various types of wireless technologies could be used. For example, near field communication (NFC), Wi-Fi, Bluetooth, etc. technologies can be used. It is not intended that there is a requirement for a specific, dedicated relationship between a wireless access points 16 and a dynamic badge 12, as may be implied in the figure. The wireless access points 16 connect to the network or the Internet, generally 22, via network infrastructure 20 (e.g., routers, web servers, etc., not shown). The network infrastructure 20 is shown in FIG. 1, as common to all of the wireless access points 16, but in practice the network infrastructure 20 would be different instances of various configurations of network infrastructure for different wireless access points 16.

Figure 2:
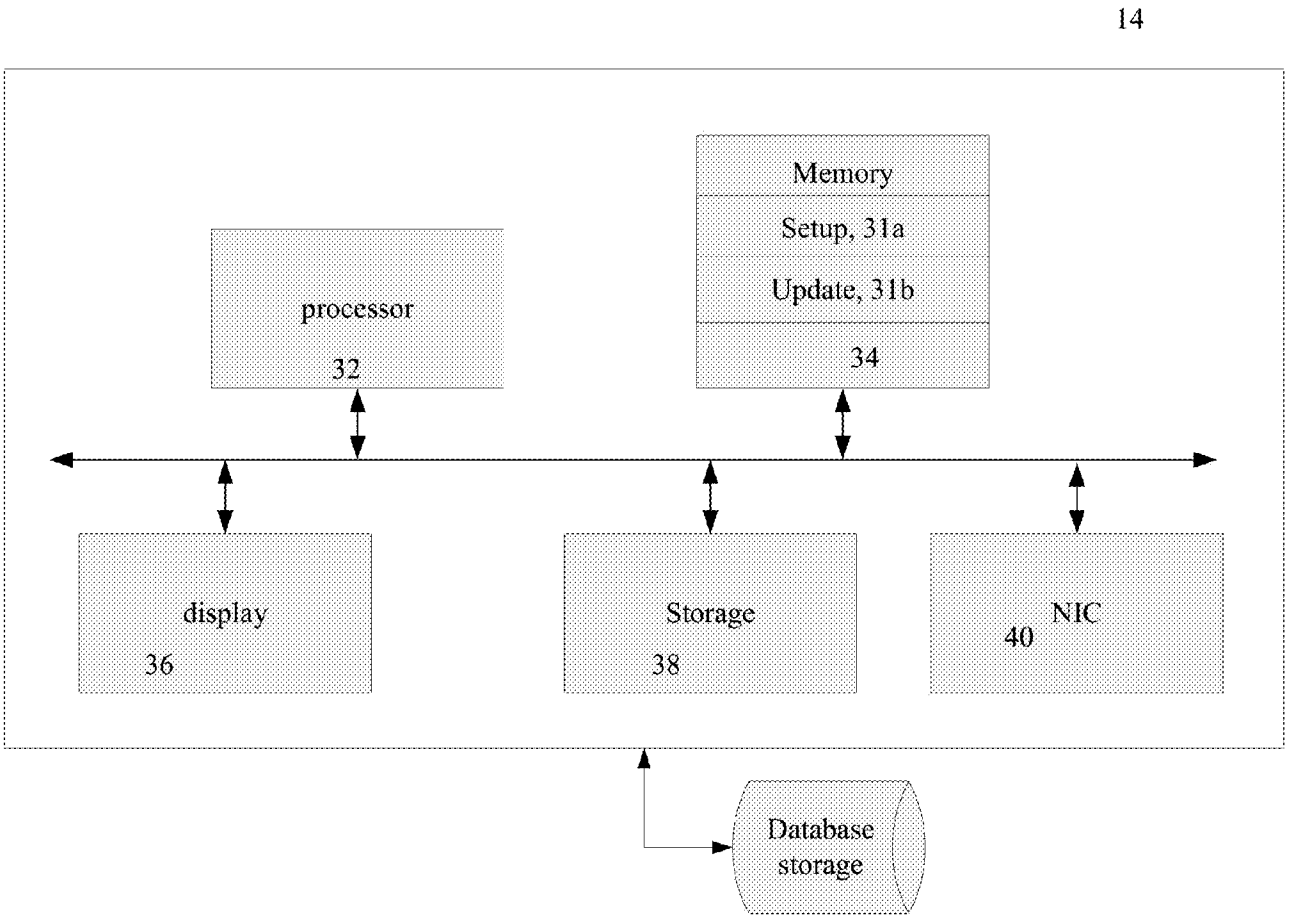
FIG. 2 is a block diagram of a server and database.

Referring now to FIG. 2, the specific, special purpose server computer 14 is shown. The server 14 includes one or more processor devices, memory, such as Random Access Memory (RAM), a display device 36, persistent storage 38, a network interface 40, as well as other circuitry that interfaces the server computer 14 to various devices, as needed. The specific, special purpose server computer 14 accesses a database 30. The database 30 includes storage devices and a database server (not shown) that store information of an organization that owns one or more of the dynamic badges of FIG. 1. The discussion below will using dynamic badge 12*a* (FIG. 1) as illustrative.

The server computer executes a setup process 31*a* (FIG. 6) that registers badge 12*a* with the server and a dynamic badge updating process 31*b* (FIG. 7) that determines whether the badge needs to be updated based on information contained in various records in the database 30, the current location of the badge, and in some instances occurrence of specific events.

Figure 3:
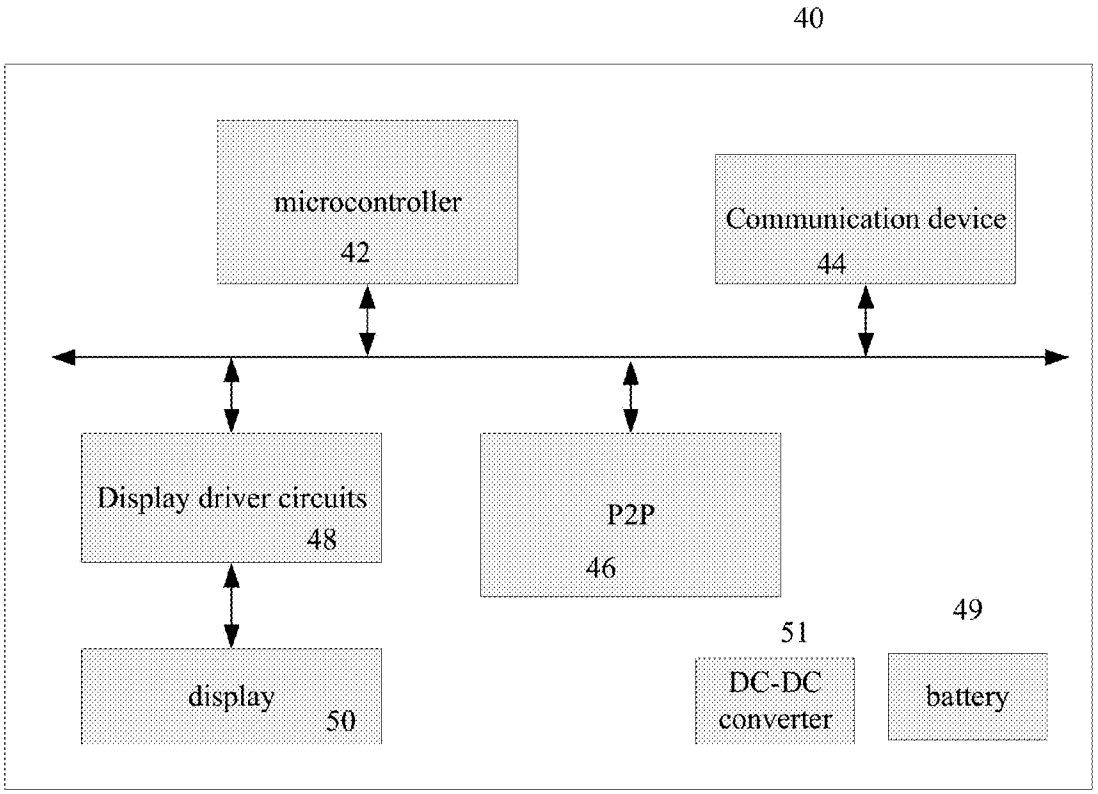
FIG. 3 is a block diagram of electronic circuitry for a dynamic badge.

Referring now to FIG. 3, electronic circuitry for a dynamic badge is shown. The electronic circuitry includes a processor device, such as a RISC (reduced instruction set processor) and in some implementations a microcontroller 42. A microcontroller as used herein refers to a class of processor devices that are small computers on a single integrated circuit and which contain a processor core, memory, and programmable input/output interfaces. The program memory (not shown) in the form of persistent RAM, e.g., ferroelectric or NOR flash or ROM and a small amount of volatile RAM (not shown) is included. Microcontrollers are typically used in embedded applications. An alternative to a microcontroller is a RISC (reduced instruction set computer) processor that uses a very small, highly optimized set of instructions to accomplish the functions disclosed below. Considerations on what specific type of processor device to use in the dynamic badges 12 include cost, integrate-ability with the display 50, and within the substrate carrier of the badge 12, and power consumption. The electronic circuitry 40 also includes a display 50 that is driven by display driver circuits 48, a communication device 44, a P2P transceiver device 46 and a battery 49.

The display 50 is an electrophoretic ink based display. While both segmented and matrix types of displays can be used depending on the degree of versatility in features required by the dynamic badges 12, in general active matrix type displays offer far more versatility. As an example, the display 50 is an electrophoretic ink based display that can be obtained from E Ink Corporation, as well as other sources. Exemplary displays include E-Ink Carta a monochromatic active matrix display with integrated drive electronics. Another example is E-Ink Spectra a color active matrix display with integrated drive electronics. Still another is E-ink Triton another active matrix display. E Ink Surf is an exemplary segmented display. Segmented displays may be used in badges that display very limited dynamic information, such as a security level or whether a person can access a facility or area within a facility.

As discussed herein the displays will be assumed to be active matrix unless otherwise specified. Typically, such displays 50 have display cells (pixels) and drive electronic circuitry to drive the cells. Generally, display modules include the drive circuits 48 for the display 50. The drive circuitry is typically TFT (thin film transistor) circuitry to control individual pixels. Other active matrix display techniques can be used.

The communication device 44 can be any sort of device, e.g., a chip or a strip, that can be detected by a Near Field Communication (NFC) based device. NFC is a technology that enables devices to establish radio communication with each other by touching devices together or bringing devices into close proximity of typically 20 cm (7.8 in) or less. NFC peers can connect to a third party NFC device that acts as a server for any action (or reconfiguration). NFC employs electromagnetic induction between two loop antennae to exchange information, e.g., between the NFC reader and the NFC chip or strip. NFC devices can work in three modes NFC Card Emulation, NFC Reader/Writer, and NFC peer-to-peer (P2P) modes. In the NFC Reader/Writer, and NFC peer-to-peer (P2P) modes the NFC device generates its own R.F. field, and would be well-suited to the dynamic badge application.

In the NFC Card emulation mode, this mode enables NFC-enabled devices such as smartphones to act like smart cards, allowing users to perform transactions. In this mode, an NFC device does not generate its own R.F. field. Rather, a NFC reader generates the field. NFC Reader/writer mode enables NFC-enabled devices to read information stored on inexpensive NFC tags embedded in labels or smart posters. NFC peer-to-peer mode enables two NFC-enabled devices to communicate with each other to exchange information in an ad hoc fashion. While all three modes may be used (for at least some of the features of the dynamic badge) it appears that the NFC peer-to-peer mode may be more suitable.

NFC tags are read only (but may be in some instances re-writable) contain data (currently between 96 and 4,096 bytes of data can be stored on an NFC tag). The NFC tags are encoded according to the badge owner's specification to include at least two piece of information, a user or more likely the dynamic badge identification (ID) that is subsequently associated with a specific user, and a uniform resource locator or (URL) that is a reference to a resource that specifies the location of the resource on a computer network and a mechanism for retrieving the resource that in the example is an application on the server computer 14.

The battery 49 can be of any electro-chemical cell type provided that the battery can satisfy the power and voltage requirements of the circuitry 40. For example, many instances of the electrophoretic ink based displays require drive voltages of 15 Volts, whereas the voltage requirements of the other circuitry 40 may be much less, e.g., 3.3 Volts or less. Thus in some applications, voltage step up is required for the display 50, which can be accomplished in various ways such as through use of a step-up DC-DC converter 51. Alternatively, a cell chemistry or battery configuration that produces the requisite voltage could be used. In other implementations another type of interface device, i.e., a P2P device could be used such as a Blue Tooth transceiver 46. A Blue Tooth transceiver would need to perform a pairing operation with a nearby Blue Tooth transceiver.

The microcontroller 42 is programmed or pre-configured with a limited instruction set that allows the microcontroller 42 to login on to a specific site and request an update. A query for an update is sent through a webserver (not shown) to application server 14, where an application on the server 14 can access data and/or update packages from the database 30. In general, update packages are time stamped, with the time that the package was produced and either stored with the package or associated with the package can be confirmations indicating that the specific update package was received by the specific one of the dynamic badge generally badges 12. Based on the state of the person in the database 30, the location, status, time, date, an event, etc. an update package is produced/retrieved and is sent back to the badge 12*a*, via the NFC reader, and the display 50 on the badge 12*a* is updated, e.g., wiped clean or has a message put on it according to the update package.

Figure 4:
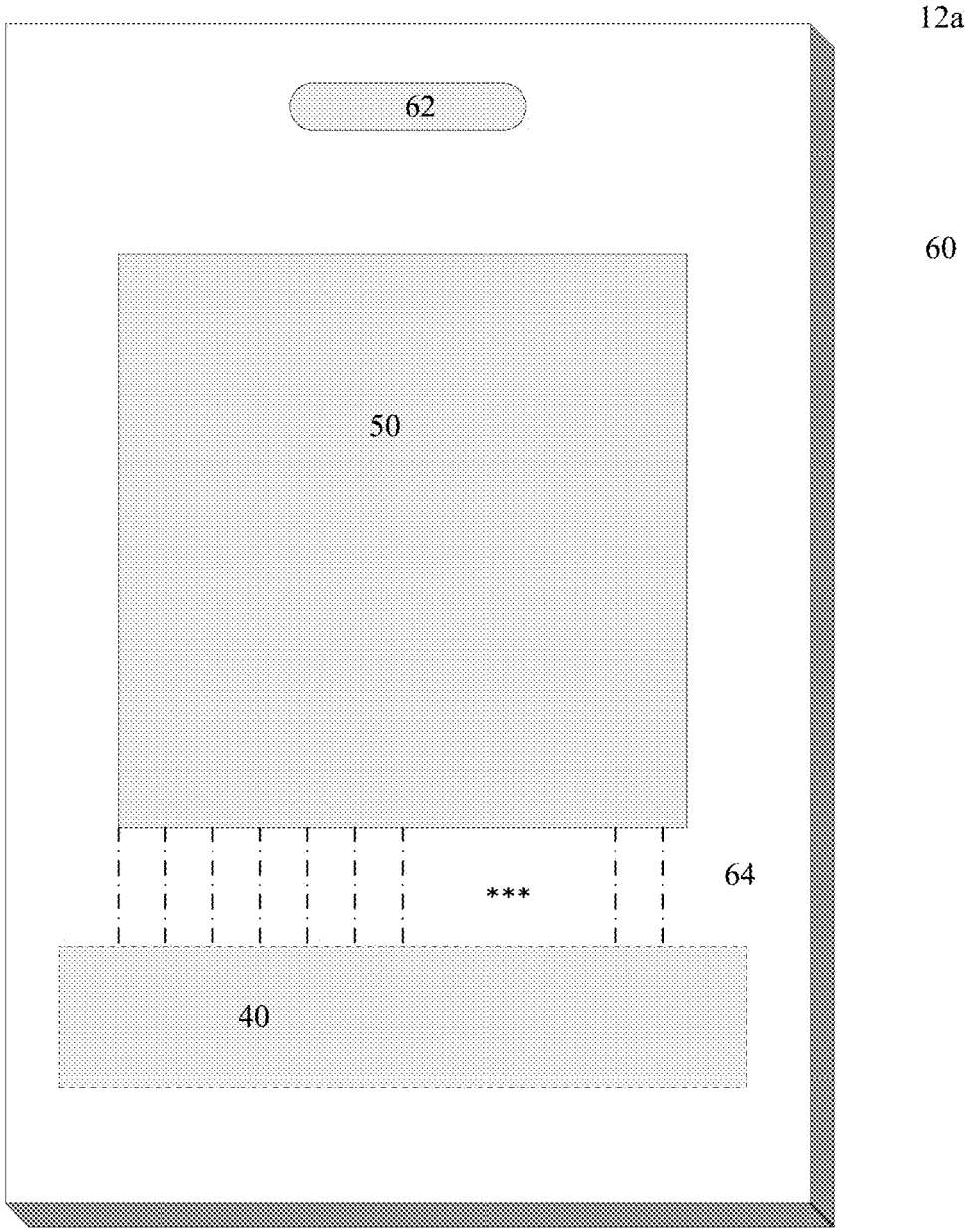
FIGS. 4 and 5 are schematic views of the dynamic badge.

Referring now to FIG. 4, an implementation of the dynamic badge 12*a* is shown. The dynamic badge 12*a* includes a substrate 60, typically a plastic sheet, having a front major surface 64 on which is provided the display 50 and in which is embedded the electronic circuitry 40 (shown in phantom) of FIG. 3. Connections between the circuitry and display and the battery are provided within the substrate. In some implementations the substrate can be a lamination of two substrates.

The dynamic badge 12*a* has an aperture 62 through which a fastener (not shown) is disposed. Common fasteners include those having a loop (not shown) of plastic with male/female snaps (not shown) at either end of the loop, with one end of the loop affixed to a clip (not shown). The loop is placed through the aperture 62 and the snaps are joined. The clip is typically a pivot-able about the affixed end of loop and the clip typically opens and closes such that it can be attached to an article of clothing.

Figure 5:
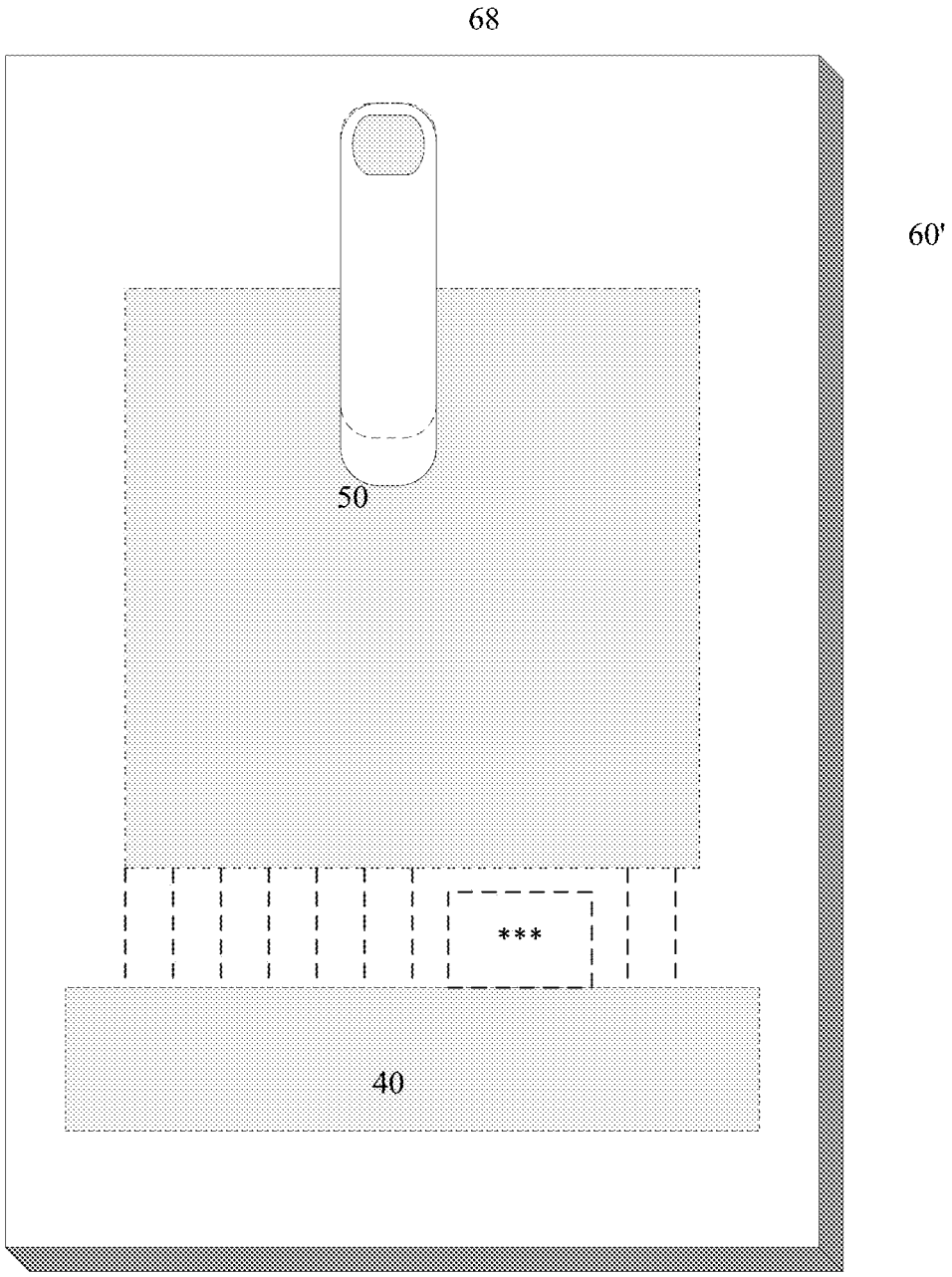

Referring now to FIG. 5, an alternative implementation of the dynamic badge 12*a* is shown from the back side view, having the substrate 60, of typically a plastic sheet, on which is provided the display 50 (shown in phantom) and in which is embedded the electronic circuitry 40 (shown in phantom) of FIG. 3. The dynamic badge 12*a* also has a permanent clip that is permanently affixed to the substrate 60. Common clips could be used including those having male/female snaps (one located on the substrate 60 the other on the clip). The clip is attached to the substrate 60 (and hence the badge 12*a*) by joining the snaps together. In this instance, the clip may be pivot-able about the affixed end of the clip that typically opens and closes such that it can be attached to an article of clothing, as above, but in this implementation the dynamic badge 12*a* can only be worn one way on an article of clothing with the display 50 facing outwards.

Figure 6:
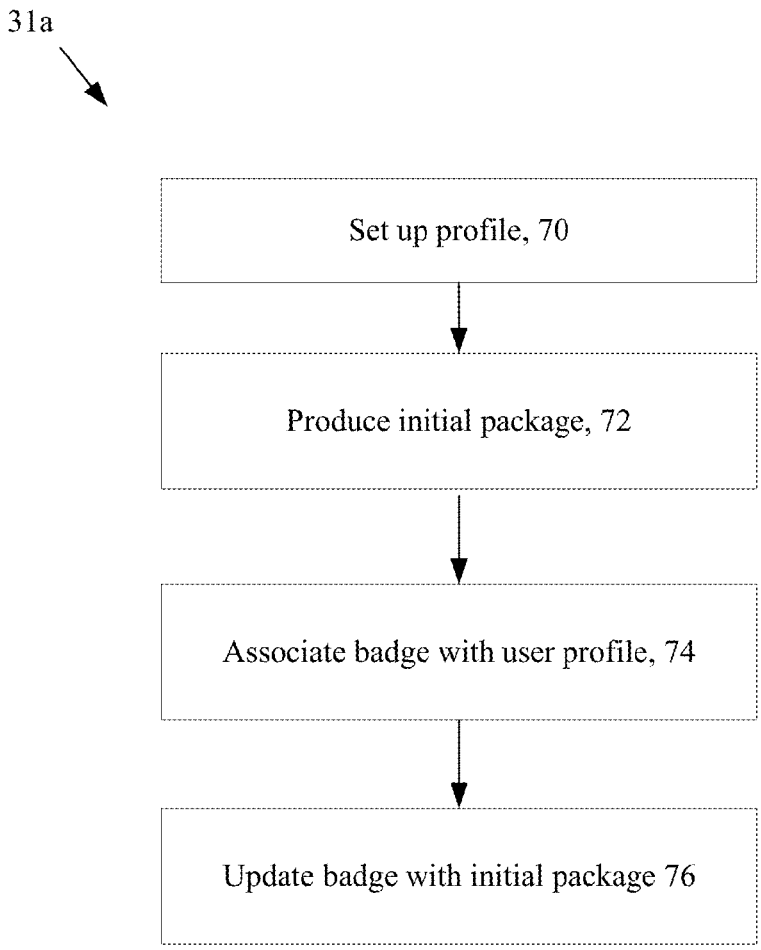
FIG. 6 is a flow chart of server processes.

Referring now to FIG. 6, the dynamic badge setup process 31*a* is shown. In this process 31*a*, a company employee sets up 70 a profile for the person that will be assigned a badge, i.e., badge user or simply user. The profile include the user's name and user's identification ID number, etc. The profile can draw on data or have links to data from other databases such as a personnel database, a security database, etc. The profile is stored in a company database 30 and the profile captures data regarding job roles or job types, as appropriate, which when processed in the server 14 according to rules (discussed below) may produce a update package that when sent to the badge causes the display 50 on the badge 12*a* to render different information at different times, physical locations, that may in addition be based on different statuses of the user, (e.g., contractor vs full time employee, vs. guest). Also, in order to promote employee loyalty from this data a rule can be used to produce update packages when the dynamic badge holder has some special status within the organization and display that special status as a message that is rendered on the dynamic badge 12*a*.

The profile will have fields for at least the following:

| |
|---|
| Name |
| Department (or equivalent such as building number, etc. one or more fields may be used) |
| Security level |
| Status (employee, contractor, etc.) |
| Assigned Badge ID no. |
| Employee ID |

As part of a setup process, an initial package is produced. This initial package includes data (in a format in a compressed format such as JPEG, TIFF, or other well-known format or in a format required by the display to minimize processing by the microcontroller) that can render on the display, information required by the organization. Depending on the capabilities of the display device, this information can include a user's picture, a user's name, a user's department, and user's security level (if required). Other information can be displayed. In some implementations where the display is of very limited capability, the display may only display text information, e.g., user's name, and various messages, but not a user's picture. The badge is associated 74 with the user's profile by applying the badge ID to the user's profile. The badge is updated 76 with the initial package by being in contact with or close proximity to a NFC reader. As part of the initial setup, the badge can be programed with the URL, but in some implementations, the server URL can be pre-programmed into the microcontroller. In any event the microcontroller includes at a minimum instructions for connecting to the specified URL and instructions for downloading an update package from a website according to the URL. The microcontroller also includes instructions that decompress the file according to the format to produce data to drive the display drivers in the display as in the above E-Ink displays.

Figure 7:
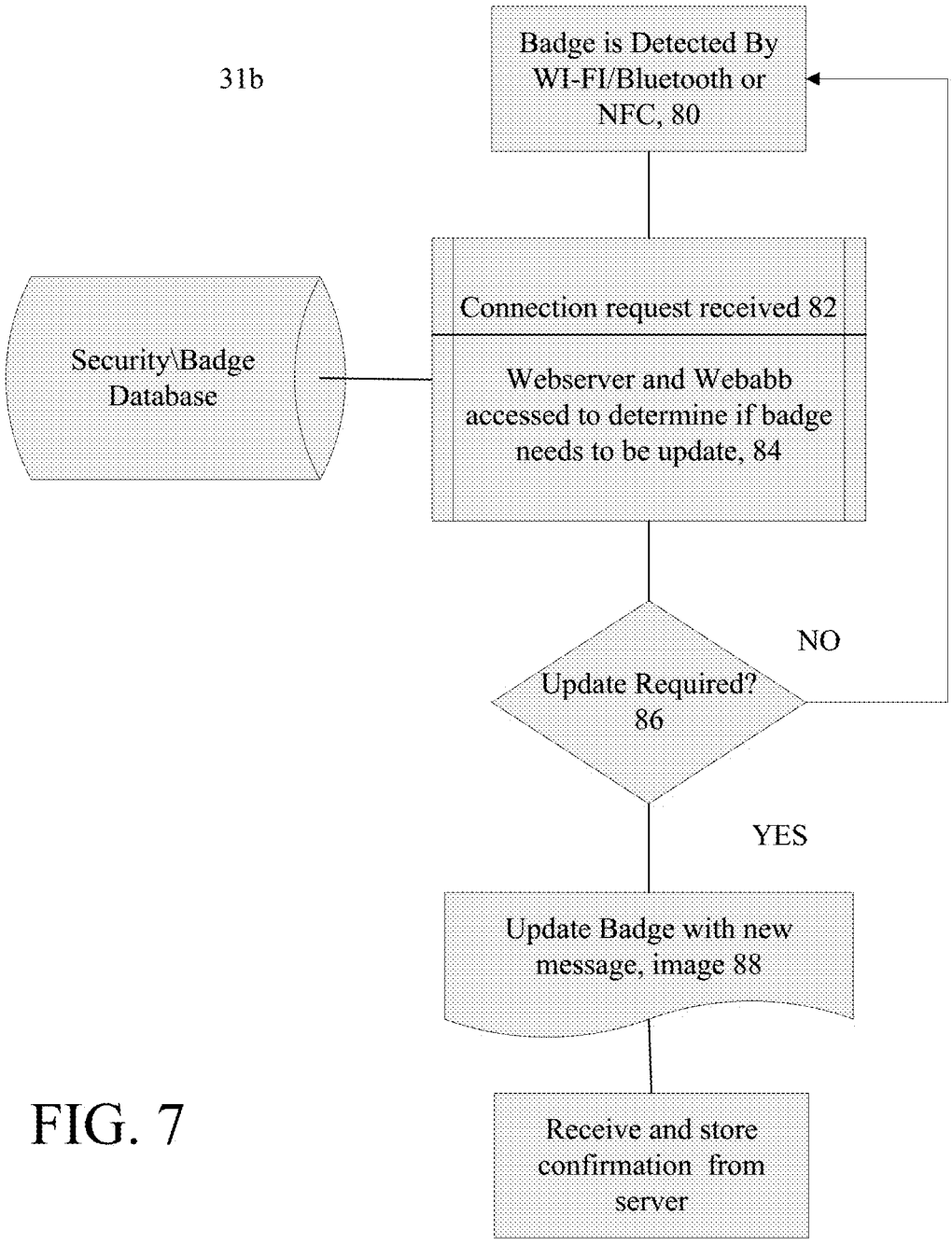
FIG. 7 is a flow chart of server processes.

Referring now to FIG. 7, updating process 31*b* is shown. In operation, a dynamic badge 12, e.g., dynamic badge 12*a* is detected 80, via WI-FI, Bluetooth or NFC reader device 16, etc. Upon detection, the reader device 16 receives 82 a connection request to connect the dynamic badge's 12*a* microcontroller 42 to a specific web server at a specific URL. Once a connection is established between the server and the microcontroller 42, the microcontroller 42 reads from its storage a badge ID and sends the badge ID to the connected web server. The web server accesses the security badge database for any information that is pertinent to the badge associated with the badge ID. The server determines whether an update of the badge is required 86. If required, the server constructs or retrieves 88 an update package that is sent to the badge. Upon receipt of the update package by the badge, the microcontroller 42 sends a confirmation to the server. The confirmation is received by the server and can be stored with the update package or can clear the update package.

The update package includes one or more messages that are rendered on the display 50. What data that is displayed is a function of several variables, including time of day, location and event, as will be discussed below.

Figure 7A:
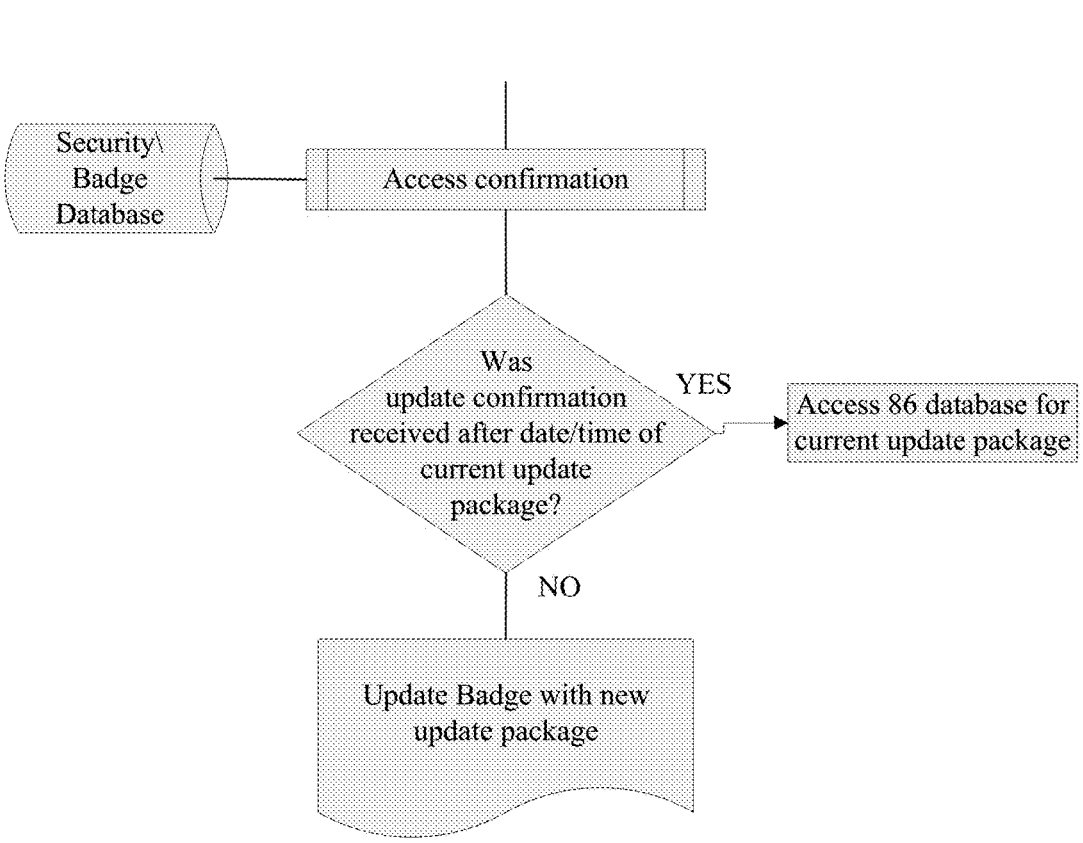
FIG. 7A is a flow chart of server processes.

Referring now to FIG. 7A, one implementation for determining whether an update is required is shown. In this implementation, the server accesses 86*a* the database for the most current update package for the dynamic badge 12*a* associated with a particular badge ID. The server accesses from the database the last confirmation of an update that was received and the time that the update confirmation was received. If the update confirmation was received after the date/time associated with the current update package the server assumes that the current update was applied to the badge and terminates the update process. On the other hand, if the update confirmation was received before the date/time associated with the current update package the server sends the update to the badge.

Figure 8:
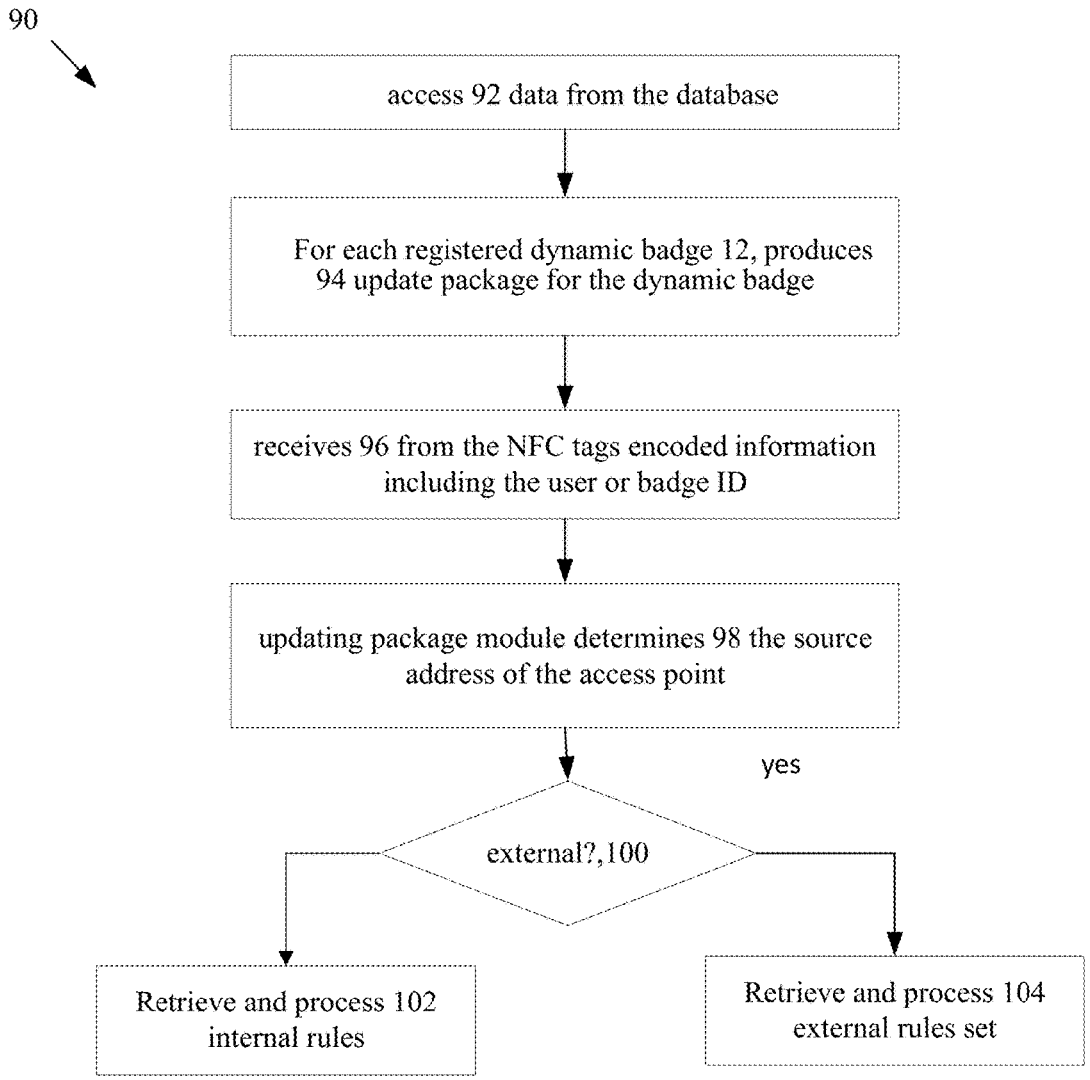
FIG. 8 is a flow chart of a server process for determining rule execution.

Referring now to FIG. 8, an updating packaging module 90 executing on server 14 for providing updating packages is shown. Server 14 is associated with the URL at the IP address specified in the URL in the NFC tag. Some updating packages are generated as batch processes meaning that the same basic package is generated for all or many such dynamic badges. Other updating packages are generated on the fly by the updating packaging module.

The updating packaging module on server 14 accesses 92 data from the database storage (or receives data from other server computers coupled to other databases such as a security database, personal database, etc.). For each registered dynamic badge 12, the updating packaging module produces 94 an update package for the dynamic badge according to various criteria including current badge location, current date, current time and events associated with the assigned user of the dynamic badge. In some implementations GPS (global position system) data can be loaded into the microcontroller via the access point as well as the time of contact with the access point by the dynamic badge 12*a*.

The updating packaging module receives 96 from the NFC tags encoded information including the user or badge ID, which corresponds to a trigger message from the badge 12*a* to the server 14 indicating an updating request. This "trigger message" is generated each time the NFC tag on the badge 12*a* is read by an access point on a network. The request to connect to the web server includes the source IP address of the access point. The trigger message is sent to the server and invokes the updating packaging module. The updating package module reads the dynamic badge ID determines 98 the source address of the access point and retrieves other information including time, date, GPS location, and events.

If the access point is within a company's network (or IP address range), a first set of rules (e.g., an on-company premises rules set) is retrieved 102, whereas if the access point is outside of a company's network a second set of rules (an off-company premises rules set) is retrieved 104. These rule sets and the specific rules within each rule set are defined typically by a company. While the rules sets generally will be different, there can be overlap in certain rules within the first and second set of rules.

For the first set of rules, the server accesses the on-company premises rules set, and determines based on the specific location, access point, time, and date, an update package. In this embodiment, the server accesses five different rules and at any point can stop processing further rules, based on one of the rules being satisfied and the appropriate update package being sent. The update process will process subsequent badge ID for other users.

Company Events Rule

A first rule can be a company events rule. For processing of the company events rule, the rule can be triggered by one or more predefined access points at specific times/dates receiving from the NFC tag the encoded badge ID. When this rule is triggered, the server retrieves a company event rule that can have the following form:

Rule name <event>; determine whether the badge ID is authorized to be at this event:
event type <event name>;
date <date of event>;
time <time of event>;
location <location of event>;
attendees <reference to a list of attendees by badge ID>
update package ID <reference to an update package>

For this rule, the server accesses the list of attendees. If the server determines that the badge ID is an authorized ID, the server retrieves an update package that has data appropriate for the event. For example, the package can include the person's name and department/business unit associated with the badge ID. In addition, the badges could dynamically display event-specific images in addition to or in lieu of a company logo. When the server receives the badge ID message from a particular one or more of the access points, indicating that the badge is close to the meeting location, the updating package is sent to the dynamic badge 12*a*.

However, for this rule if the server determines that the badge ID is not an authorized ID based on the list of attendees, the server retrieves a different update package that has different data appropriate for the user not being part of the event, such as a friendly message indicating that the person is not authorized for the event.

Employee Termination Rule

A second rule can be an employee termination rule. For processing of the employee termination rule, the rule can be triggered by any access point at any time/date receiving from the NFC tag the encoded badge ID. When this rule is triggered, the server retrieves employee termination rule that can have the following form:

Rule name <employee termination rule>;

Terminated employee <reference to a list of terminated employees by badge ID> update package ID <reference to an update package>

In this situation the update package can simple automatically wiped off all data from the display and disable the processor from receiving any further updates from the server 14, such as by deleting URL and otherwise disabling the badge, etc. As the badge includes the NFC chip or strip, the NFC reader may still make a connection with the badge once wiped clean, however by deleting the URL, etc. no further update requests can be made and thus the badge will remain blank.

Thus, when a terminated employee walks by or stands in an area with an active NFC reader (or a Wi Fi), the NFC reader performs a handshake with the badge, the reader through an access point connects to the server, and the server sends the update package that automatically wipes off all data from the display and can delete the URL or otherwise disables the processor. The terminated employee need not be on company premises for this rule to be executed.

Employee Offsite Rule

A third rule can be an employee off premises rule. For processing of the employee off premises rule, the rule can be triggered by access points at the perimeter of a company facility, at any time/date receiving from the NFC tag the encoded badge ID. When this rule is triggered, the server retrieves employee off premises rule that can have the following form:

Rule name <employee off premises rule>;
locations <access points that trigger the rule>;
update package ID <reference to an update package>

In this situation the update package automatically wipes off all data from the display, as in the employee termination rule, but without disabling the processor from receiving any further updates from the server 14. Thus, by leaving the URL, etc. active on the badge, as the NFC chip or strip on the badge come into proximity with an NFC reader, the chip/strip can make a connection with the badge and the microcontroller can access the resource specified by the URL, at the server 14, etc. to provide new update requests and receive new update packages that render badge information on the monitor 50.

Thus, the dynamic badge 12*a* is configured to automatically appear blank with no identifying information whatsoever once the employee is outside of a range of a company's property. This range would be determined by user preferences and by capabilities of the access points used in communicating with the dynamic badge 12*a*. Therefore, when commuting to/from work, the badge would not be visible to others and would only wirelessly "activate" near an NFC reader at specific on company premises access points.

Security Level Access Rule

In many companies, hospitals, and other settings such as government facilities there is a need to have different types of badges for different security level access, for distinguishing between contractor vs employees, full time employees, vs. part time, etc. Often these different levels are fixed for a specific duration and then expire.

A fourth rule can be a security level access rule. For processing of the security level access rule, the rule can be triggered by any access points at the perimeter of a company facility or within a company facility, at any time/date receiving from the NFC tag the encoded badge ID. When this rule is triggered, the server retrieves the security level access rule that can have the following form:

Rule name <security level access>;
locations <access points that trigger the rule>;
update package ID <reference to an update package>

In this situation, the update package automatically applies a message to the display from the server 14 that indicates a security level. With this rule, badges 12 are provided with instructions that cause the badges to look different for persons according to the person's relationship to the company. For example, different colors can be applied to the dynamic badge 12*a* to identify access level. With the dynamic badge 12*a*, those identifiers can allow employees to more easily monitor non-employees and prevent security breaches, etc.

Offsite Event Rule

A group of employees are at a dinner at an external site. The server 14 can allow the employee (through an internal site) to program their badge to display, more limited information (such as only their first name) or this could be controlled by a corporate function.

A fifth rule can be an offsite event rule. For processing of the offsite event rule, the rule can be triggered by any access points outside of a company facility, at any time/date, receiving from the NFC tag the encoded badge ID. When this rule is triggered, the server retrieves the offsite event rule that can have the following form:

```
Rule name <offsite event>;
locations <any external access points can trigger the rule>;
update package ID <reference to an update package>
```

In this situation, the update package automatically applies a message to the display from the server 14 that merely displays the wearer's first name (or some other information).

Other rules can be devised. In addition, other information can be displayed such as updating a person's badge with their years of employment, indicating a service anniversary or a congratulatory message, etc.

For a more secure environment, security labels can be displayed in the display 50 on the badge 12*a*. For example, when a user is in an authorized area part of the display can display a message, e.g., "authorized" (or the like) or the display 50 on the badge 12 can have a specific color, e.g., green (or other color whose convention is understood). However, when an authorized user of a badge 12*a* is in unauthorized area for that user, an update message can be produced to indicate to others to deny access by displaying on the display a message such as "deny access" and/or by turning the display 50 on the dynamic badge 12*a* to a different color, e.g., red (or other color whose convention is understood). When a contractor, which has a different badge color, is hired as a permanent employee, rather than issuing a new physical badge, the dynamic badge can be wiped & updated to an employee badge by an appropriate update package. The badges can be used as name tags for easy identification at events and locations. Many other use cases, e.g., rules, can be developed using the above described techniques.

The dynamic badges requires a special computing device that is capable of taking input from an access point on a network. Server computers are computing systems, such as a distributed computing systems. Server computers may be a single server or a group of servers that are at a same location or at different locations and could be cloud-based servers.

Servers receive information from the NFC devices on the dynamic badges, via a suitable interface. Servers also include processor and memory and a bus system (not shown), including, for example, an information bus and a motherboard, can be used to establish and to control information communication between the components of server.

Processors generally are microcontrollers, commonly used in embedded applications that have sufficient processing power for receiving and storing information, and communicating over a network to the server and which can interface with the display driver circuitry. Memory is generally included in the microcontroller and can include random access memory and other types of non-transitory machine-readable storage devices.

Embodiments can be implemented in digital electronic circuitry. Apparatus of the invention can be implemented in a computer program product tangibly embodied or stored in a machine-readable storage devices and/or machine readable media for execution by a programmable processor in the server and/or the microcontroller in the dynamic badge. The computer program product thus includes a program of instructions to perform functions and operations of the invention by operating on input information and generating output and which is stored in tangible, non-transitory media that can be persistent storage or volatile storage.

The invention can be implemented advantageously by one or more computer program products that are stored on computer readable hardware devices and which are executable on a programmable system including at least one programmable processor coupled to receive information and instructions from, and to transmit information and instructions to, an information storage system, at least one input device, and at least one output device.

Each computer program can be implemented in a high-level procedural or object oriented programming language, or in assembly or machine language if desired; and in any case, the language can be a compiled or interpreted language.

A number of embodiments of the invention have been described. Nevertheless, it will be understood that various modifications may be made without departing from the spirit and scope of the invention. In other implementations, the dynamic badge can be used as a hotel key, an apartment key or a locker key. Accordingly, other embodiments are within the scope of the following claims.

What is claimed is:

1. A method of managing a badge having at least one display device on the badge and a badge identification (ID), the method comprising:

receiving by a computer, a message that identifies a user to which the badge is assigned, the message being received over a network from a network access point having a network IP address;

establishing, by the computer, in response to receiving the message, a communication channel between the computer and a processor device on the badge to enable the processor device to retrieve the badge ID and provide the badge ID to the computer;

executing by the processor device instructions for connecting to a uniform resource locator (URL) once the badge is detected by the network access point, with the URL being an address of a resource at which update packages are downloaded, with the URL being pre-programmed in the processor device and provided to the computer via the message;

receiving by the computer an IP address of the access point that received the message to provide geographic location information that indicates a current location of the badge;

accessing by the computer a database that stores information associated with the user;

executing by the computer a rule to determine an update package to send to the badge, with the rule selected from a rule set of a plurality of rule sets, and the rule set selected according to the IP address of the access point, and the rule selected based on the accessed information from the database, and the current location of the badge, with the update package comprising specific information to display on the display device of the badge; and forwarding by the computer the determined update package over the network to a communication node for delivery to the badge.

2. The method of claim 1 further comprising, upon establishing the communication channel, constructing by the computer the determined update package.

3. The method of claim 1 wherein executing the selected rule further comprises:

accessing by the computer the database to retrieve current status information of the user; and selecting the rule from the rule set based on the physical location of the badge at the time that the message is received and current status information of the user.

4. The method of claim 1 further comprising:

accessing by the computer the rule set;

selecting by the computer, the rule from the rule set, the rule selected according to the current location of the badge and the time that the message was received by the computer; and wherein executing the rule is further based on a location of the access point.

5. The method of claim 1 further comprising:

detecting by the computer establishment of a communication channel by circuitry on the badge; and determining by the computer whether an update to the badge is required by executing one or more rules from the rule set.

6. The method of claim 5 wherein determining whether an update is required, further comprises:

accessing by the computer a record that is associated with the badge;

reading by the computer whether the record contains an acknowledgement message of a previous update being applied by the badge; and determining whether there is a new update for the badge that is later than a timestamp associated with the acknowledgement message.

7. The method of claim 6 further comprising:

sending by the computer the new update when the acknowledgement message has a timestamp later than a timestamp of the new update.

8. The method of claim 1 wherein executing by the computer the instructions to determine an update package, further comprise:

receiving by the computer from NFC tags on the badge encoded information including the badge ID;

determining by the computer the source address of the access point that read the encoded information;

determining by the computer, whether the access point is within a company's network; and selecting by the computer from the rule set, the rule according to whether the access point is within or outside of the company network.

9. The method of claim 8 wherein the rule is selected from a set of on-company premises rules that comprise:

a company events rule that when executed determines whether the badge ID is authorized to be at a specified event, by the computer:

accessing a list of attendees; and determining whether the badge ID is an authorized ID for the event; and sending an update to the badge, where the update is selected according to the execution of the company events rule.

10. The method of claim 8 wherein the rule is selected from a set of off-company premises rules that comprise:

an employee termination rule that when executed determines whether the badge ID is a terminated badge, by:

receiving from any access point that is connected with the badge from the NFC tag the encoded badge ID;

accessing by the computer a list of terminated employees by badge ID; and sending by the computer an employee termination update package ID when the identification of the badge is on the list.

11. The method of claim 10 wherein the employee termination update package includes instructions that when executed by the badge, automatically wipe off all data from the display and disable the processor device in the badge from receiving any further updates, by at least deleting the URL stored in the badge.

12. A system for managing dynamic badges each dynamic badge have at least one display device supported on the badge and a badge identification (ID), the system comprising:

a computer system comprising:

a processor and a memory coupled to the processor, the system being configured to:

receive a message with the message identifying a user to which the badge is assigned, the message being received over a network from a network access point having a network IP address;

receive from a processor device on the badge the message which is a request to establish a communication channel between with the computer and the processor device to enable the processor device to retrieve the badge ID and provide the badge ID to the computer, the processor device configured to execute instructions for connecting to a uniform resource locator (URL) once the badge is detected by the network access point, with the URL being an address of a resource at which update packages are downloaded, with the URL being pre-programmed in the processor device and provided to the computer via the message;

receive an IP address of the access point that received the message to provide geographic location information that indicates a current location of the badge;

access a database that stores information associated with the user;

select a rule with the rule selected from a rule set of a plurality of rule sets, and the rule set selected according to the IP address of the access point, and the rule selected according to the current location of the badge and the time that the message was received by the computer;

execute the selected rule to determine an update package to send to the badge, with rule execution based on accessed information from the database, the current location of the badge, and the IP address of the access point, with the update package comprising specific information to send to the badge for display on a display device carried by the badge; and forward the determined, update package over the network to a communication node for delivery to the badge.

13. The system of claim 12 further comprising:

a near field reader coupled to a server to establish by the processor device on the badge, a communication channel with the computer system.

14. The system of claim 12 further comprising the system configured to:

access a record that is associated with the badge;

determine whether the record contains an acknowledgement message of a previous update being applied by the badge; and determine whether there is a new update for the badge that is later than a timestamp associated with the acknowledgement message.

15. The system of claim 14 further comprising the system configured to:

send the new update when the acknowledgement message has a timestamp later than a timestamp of the new update; otherwise determine whether a new update should be generated based on the time, day, and current location of the badge.

16. The system of claim 12 further comprising the system configured to:

produce an update package for the badge;

receive from NFC tags on the badge the encoded information including the badge ID;

determine the source address of the access point that read the encoded information;

determine whether the access point is within a company's network; and select from the rule set, the rule according to whether the access point is within or outside of the company network.

17. The system of claim 16 wherein the rule is selected from a set of on-company premises rules that comprise:

a company events rule that when executed by the system determines whether the badge ID is authorized to be at a specified event, by the system configured to:

access a list of attendees; and determine whether the badge ID is an authorized ID for the event; and send an update to the badge, where the update is selected according to the execution of the company events rule.

18. The system of claim 16 wherein the rule is selected from a set of off-company premises rules that comprise:

an employee termination rule that when executed by the system determines whether the badge ID is a terminated badge, by the system configured to:

receive from any access point that is connected with the badge from the NFC tag the encoded badge ID;

access a list of terminated employees by badge ID; and send an employee termination update package ID when the identification of the badge is on the list.

19. The system of claim 18 wherein the employee termination update package includes instructions that when executed by the badge, automatically wipe off all data from the display and disable the processor device in the badge from receiving any further updates, by at least deleting the URL stored in the badge.

* * * * *